United States Patent [19]

Wassenhoven

[11] Patent Number: 4,829,762

[45] Date of Patent: May 16, 1989

[54] METHOD AND DEVICE FOR IMPROVING A YARN PRODUCED IN THE ROTOR OF AN OPEN-END SPINNING APPARATUS

[75] Inventor: Heinz-Georg Wassenhoven, Moenchengladbach, Fed. Rep. of Germany

[73] Assignee: W. Schlafhorst & Co., Monchen-Gladbach, Fed. Rep. of Germany

[21] Appl. No.: 158,572

[22] Filed: Feb. 22, 1988

[30] Foreign Application Priority Data

Feb. 20, 1987 [DE] Fed. Rep. of Germany ..... 3705479

[51] Int. Cl.[4] ..... D01H 7/882; D02G 1/04

[52] U.S. Cl. ..... 57/417; 57/334; 57/341; 57/344; 57/352

[58] Field of Search ..... 57/404, 334, 408, 341, 57/415, 344, 417, 352

[56] References Cited

U.S. PATENT DOCUMENTS

| | | | |
|---|---|---|---|
| 3,789,597 | 2/1974 | Schon | 57/417 |
| 4,258,541 | 3/1981 | Le Chatelier et al. | 57/417 |
| 4,458,477 | 7/1984 | Raasch et al. | 57/415 |
| 4,481,766 | 11/1984 | Kurushima et al. | 57/417 |
| 4,499,719 | 2/1989 | Faessler | 57/417 |
| 4,516,397 | 5/1985 | Raasch et al. | 57/417 |
| 4,665,687 | 5/1987 | Ott et al. | 57/417 |

*Primary Examiner*—John Petrakes

*Attorney, Agent, or Firm*—Herbert L. Lerner; Laurence A. Greenberg

[57] ABSTRACT

A method and a device for improving a yarn produced with genuine twist in the rotor of an open-end spinning apparatus directs the yarn through a yarn take-off nozzle in a given yarn travel direction. The yarn is subsequently diverted from the given yarn travel direction first to one side and then back to the opposite side over false-twist edges disposed obliquely relative to the given yarn travel direction including a last false-twist edge. Outer fiber ends of the traveling yarn are spread radially apart after passing the last false-twist edge. The yarn is subsequently passed through a pair of delivery rollers.

9 Claims, 1 Drawing Sheet

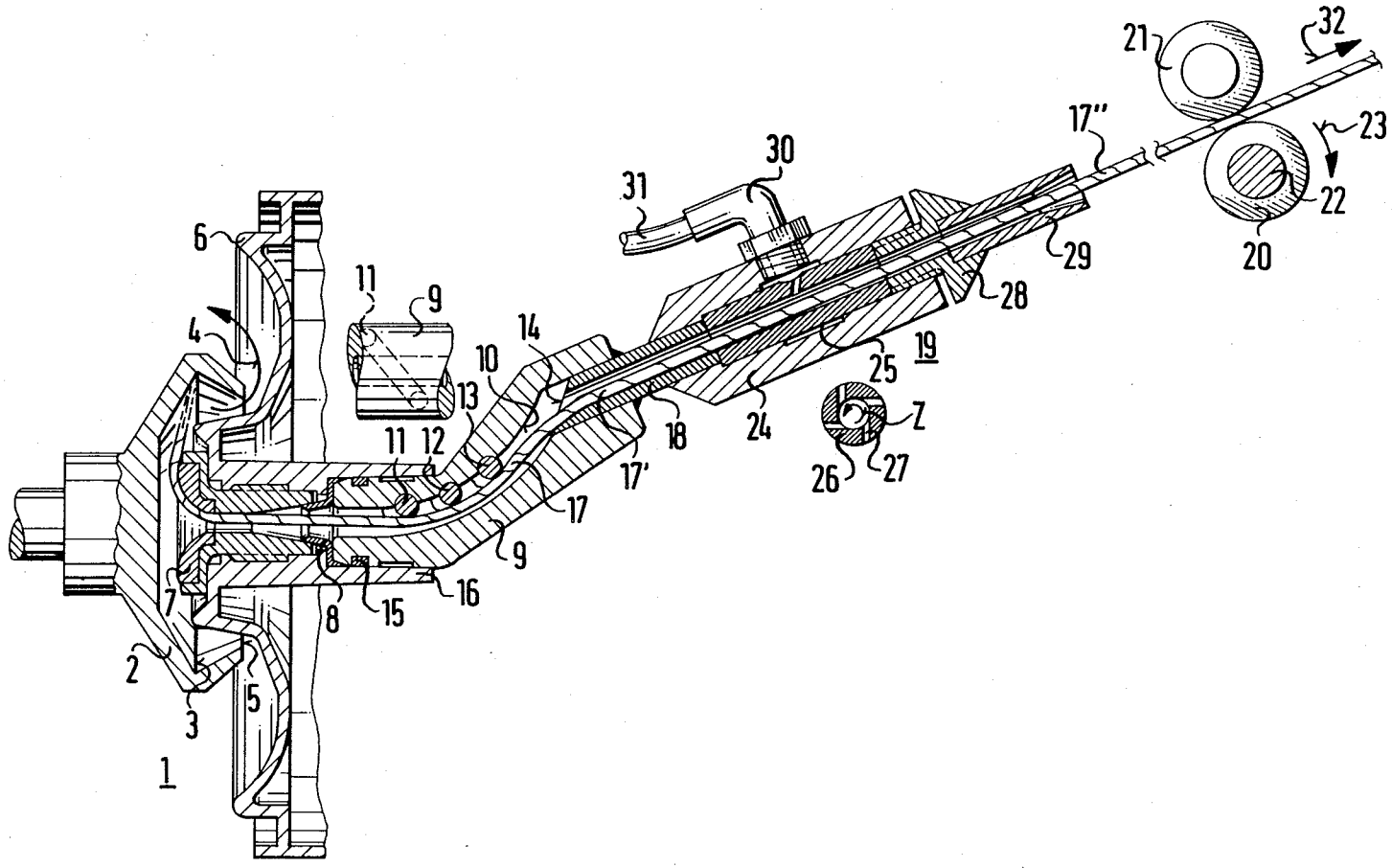
32
23
22
20
21
17''
29
28
19
7
27
25
26
30
24
31
18
17'
17
14
9
10
13
16
9
12
11
15
11
8
5
6
4
3
7
2
1

METHOD AND DEVICE FOR IMPROVING A YARN PRODUCED IN THE ROTOR OF AN OPEN-END SPINNING APPARATUS

The invention relates to a method and a device for improving a yarn produced with a genuine twist in the rotor of an open-end spinning apparatus, the yarn being directed through a yarn take-off nozzle, then diverted from the yarn travel direction first to one side and then back to the opposite side over false-twist edges disposed obliquely relative to the yarn travel direction, and finally passing through a pair of delivery rollers.

With an otherwise good spinning outcome, articles produced from such yarn have a rather hard texture.

It is accordingly an object of the invention to provide a method and a device for improving a yarn produced in the rotor of an open-end spinning apparatus, which overcomes the hereinafore-mentioned disadvantages of the heretofore-known methods and devices of this general type, which improves the spinning outcome and which also lends a softer texture to the goods produced from the spin yarn, in particular knitted goods.

With the foregoing and other objects in view there is provided, in accordance with the invention, a method for improving a yarn produced with genuine twist in the rotor of an open-end spinning apparatus, which comprises directing the yarn through a yarn take-off nozzle in a given yarn travel direction, subsequently diverting the yarn from the given yarn travel direction first to one side and then back to the opposite side over false-twist edges disposed obliquely relative to the given yarn travel direction including a last false-twist edge, spreading outer fiber ends of the traveling yarn radially apart after passing the last false-twist edge, and subsequently passing the yarn through a pair of delivery rollers.

The yarn thus produced is distinguished by greater fuzziness because of the spreading apart of the outer fiber ends, so that the finished article has the desired softer texture.

In accordance with another mode of the invention, there is provided a method which comprises directing the traveling yarn through a fiber spreader after passing the last false-twist edge during the spreading step.

In accordance with a further mode of the invention, there is provided a method which comprises exposing the traveling yarn to a cyclonic flow after passing the last false-twist edge during the spreading step.

In accordance with an added mode of the invention, there is provided a method which comprises reinforcing the genuine twist on the feed side by providing a false twist to the traveling yarn with the cyclonic flow.

Priot to passing the cyclonic flow, the yarn is given a greater twist and thus a greater buildup of rotation. Due to the cyclonic flow, the segment of yarn extending between the cyclonic flow and the clamping point formed by the pair of delivery rollers is set into oscillation and subjected to centrifugal force, resulting in a spreading apart of the outer fiber ends of the fiber strand.

With the objects of the invention in view, there is also provided a device for improving a yarn produced with genuine twist in the rotor of an open-end spinning apparatus, comprising a yarn take-off nozzle through which the yarn is directed in a given yarn travel direction, false-twist edges including a last false-twist edge disposed obliquely relative to the given yarn travel direction downstream of the yarn take-off nozzle over which the yarn is diverted first to one side and then back to the opposite side from the given yarn travel direction, a fiber spreader through which the yarn travels downstream of the last false-twist edge, and a pair of delivery rollers downstream of the fiber spreader.

The outer fiber ends spread apart from the fiber strand result in the greater fuzziness that contributes to a softer texture in the finished article, which is particularly advantageous in knitted goods. The yarn take-off speed can be high with relatively less rotation, so that the invention also increases the productivity of the open-end spinning apparatus, and the overall spinning outcome is better than in the prior art.

In accordance with another feature of the invention, the fiber spreader includes a device for generating a cyclonic flow rotating about the longitudinal axis of the yarn.

In accordance with a further feature of the invention, the device for generating a cyclonic flow includes a tube through which the yarn travels, and at least one tangential conduit through which compressed air discharges into the tube.

In accordance with an added feature of the invention, the genuine twist of the yarn has a given rotational direction, and the cyclonic flow also has the given rotational direction, whereby a yarn segment upstream of the fiber spreader is given a false twist reinforcing the genuine twist.

In accordance with a concomitant feature of the invention, there is provided a tube adjoining the yarn take-off nozzle being bent toward one side from the given yarn travel direction, the tube having at least one of the false-twist edges disposed therein narrowing the free cross section of the tube at a generatrix of the tube having the shortest radius of curvature, and the tube having an end at which at least one other of the false-twist edges is disposed for diverting the yarn out of the travel direction toward the opposite side.

Other features which are considered as characteristic for the invention are set forth in the appended claims.

Although the invention is illustrated and described herein as embodied in a method and device for improving a yarn produced in the rotor of an open-end spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection single figure of the drawing.

The drawing is a fragmentary, diagrammatic, longitudinal-sectional view of a device according to the invention.

Referring now to the single figure of the drawing in detail, there is seen an open-end spinning device designated overall by reference numeral 1, which has a rotor 2 having a fiber collecting groove 3 into which spinning fibers are continuously introduced in a non-illustrated manner, while the interior of the rotor is vented continuously in the direction of an arrow 4 through a rotor rim 5 and underneath a cap 6 that covers the rotor 2.

A yarn take-off or withdrawal nozzle 7 is centrally inserted into the cap 6 and a tube 9 that is bent in one direction or toward one side, in this case upward, away from the direction of yarn travel, is connected to the yarn takeoff nozzle 7 through an interposed yarn guide funnel 8. The tube 9 has three mutually aligned false-twist edges 11, 12, 13 which are disposed obliquely relative to the yarn travel direction and which restrict the free tube cross section, which is otherwise circular, at a tube surface line, generatrix or jacket line 10 having the least radius of curvature. The false-twist edges 11, 12, 13 are in the form of pins inserted into bores, which are oblique relative to the yarn travel and penetrate the tube jacket, in such a way that the pins protrude from the tube surface line or generatrix 10 having the least radius of curvature into the free cross section of the tube 9. In the drawing, this is shown in particular for the falst-twist edge 11, which serves as an example.

False-twist edges with completely rounded edges are provided in the illustrated embodiment. In other embodiments, rib-like pins, triangular pins or the like can be used instead of the pins having a circular cross section, in order to obtain less-well-defined rounding of the false-twist-edges.

The tube 9 is pressed along with a sealing ring 15, into a cylindrical connection stub 16 of the cap 6. A further false-twist edge 14, which is also disposed obliquely relative to the yarn travel, is located at the end of the tube 9. Yarn 17 produced in the rotor 2 first travels through the yarn take-off nozzle 7 and is then diverted upward from its travel direction by the false-twist edges 11, 12 and 13. The false-twist edge 14 diverts the yarn 17 back again out of its travel direction and toward the opposite direction or side. The false-twist edge 14 is located on an oblique end of the yarn entry side of a further tube 18, which protrudes into the tube 9 at an angle relative to the axis of the tube 9.

A pneumatic fiber spreader 19 is connected to the tube 18. The yarn 17 passes through the fiber spreader 19 and then through a pair of delivery rollers 20, 21. The delivery roller 20 is drivable by means of a shaft 22 in the direction of an arrow 23, while the delivery roller 21 which is in the form of a friction-driven pressing roller, can be pressed with applied pressure against the delivery roller 20, or in other words against the yarn 17.

After passing through the pair of delivery rollers 20, 21, the yarn 17 is wound up into a coil, in a non-illustrated manner.

The pneumatic fiber spreader 19 is formed of a casing tube 24, into which an annular conduit 25 is machined. The casing tube 24 is pressed onto the tube 18. The casing tube 24 has a tubular twist insert 26 serving as a false-twist device for producing a cyclonic flow Z. At the level of the annular conduit 25, the insert 26 has four tangential conduits 27 extending at a slight inclination with respect to the yarn travel direction. The twist insert 26 is firmly retained in the casing tube 24 by a screw connection 28. The screw connection 28 has a yarn outlet tube 29, which is flared in funnel-like fashion toward the yarn outlet side.

At the level of the annular conduit 25, the casing tube 24 has a threaded bore into which a hose connection stub 30 is screwed. A compressed air hose 31 terminates in the hose connection stub and leads to a source of compressed air through a non-illustrated switchable valve. The yarn take-off or withdrawal direction is indicated by an arrow 32.

The false-twist edges 11–14 are oriented in such a way that the direction thereof matches the yarn twist direction prevailing at the respective edges.

The orientation of the tangential conduits 27 also takes the yarn twist into account, so that the cyclonic flow Z acts clockwise upon the yarn 17 in the case of a clockwise twist and counterclockwise in the case of a counterclockwise twist. The traveling yarn undergoes a reinforcement of twist in a yarn segment 17' located upstream of the pneumatic fiber spreader 19 and a contrary twist in a yarn segment 17'' located between the pneumatic fiber spreader 19 and the pair of delivery rollers 20, 21. During the travel of the yarn after leaving the cyclonic flow Z, the falst twist is untwisted no later than a clamping point represented by the pair of delivery rollers 20, 21. What remains is the genuine twist that the rotor 2 imparts to the yarn 17 as the yarn producer, which has great spinning strength.

I claim:

1. Method for improving a yarn produced with genuine twist in the rotor of an open-end spinning apparatus, which comprises initially directing the yarn through a yarn take-off nozzle centrally disposed relative to the rotor in a yarn travel direction, subsequently guiding the yarn straight and substantially centrally relative to the rotor in a given withdrawal direction, subsequently diverting the yarn laterally in a given plane into a first direction forming a given angle with the given withdrawal direction over first false-twist edges disposed obliquely relative to the yarn travel direction, subsequently diverting the yarn in the given plane into a second direction forming an angle with the given withdrawal direction smaller than the given angle over a last false-twist edge disposed obliquely relative to the yarn travel direction, imparting a false-twist onto the traveling yarn leading to fiber spreading yarn movements and/or oscillations spreading outer fiber ends of the traveling yarn radially apart after passing the last false-twist edge, and subsequently passing the yarn through a pair of delivery rollers in the second direction.

2. Method according to claim 1, which comprises directing the traveling yarn through a fiber spreader after passing the last false-twist edge during the spreading step.

3. Method according to claim 1, which comprises exposing the traveling yarn to a cylconic flow after passing the last false-twist edge during the spreading step.

4. Method according to claim 3, which comprises reinforcing the genuine twist on the feed side by providing a false twist to the traveling yarn with the cyclonic flow.

5. Device for improving a yarn produced with genuine twist in the rotor of an open-end spinning apparatus, comprising a yarn take-off nozzle disposed centrally relative to the rotor through which the yarn is initially directed in a yarn travel direction and after which the yarn is directed straight and substantially centrally relative to the rotor in a given withdrawal direction, first false-twist edges disposed obliquely relative to the yarn travel direction downstream of said yarn take-off nozzle over which the yarn is diverted laterally in a given plane into a first direction forming a given angle with said given withdrawal direction, a last false-twist edge disposed obliquely relative to the yarn travel direction downstream of said first false-twist edges over which the yarn is diverted in said given plane into a second direction forming an angle with said given withdrawal direction being smaller than said given angle, a pair of delivery rollers forming a clamping point through which the yarn passes in said second direction, and a false-twist device through which the yarn travels between said last false-twist edge and said pair of delivery rollers, said false-twist device being spaced from said pair of delivery rollers by a distance allowing formation of fiber spreading oscillations and/or centrifugal forces in a yarn segment between said false-twist device and said clamping point.

6. Device according to claim 5, wherein said false-twist device includes a device for generating a cyclonic flow rotating about the longitudinal axis of the yarn.

7. Device according to claim 6, wherein said device for generating a cyclonic flow includes a tube through which the yarn travels, and at least one tangential conduit through which compressed air discharges into said tube.

8. Device according to claim 6, wherein the genuine twist of the yarn has a given rotational direction, and the cyclonic flow also has said given rotational direction, whereby a yarn segment upstream of said false-twist device is given a false twist reinforcing the genuine twist.

9. Device according to claim 5, including a tube adjoining said yarn take-off nozzle being bent toward one side from the yarn travel direction, said tube having at least one of said false-twist edges disposed therein narrowing the free cross section of said tube at a generatrix of said tube having the shortest radius of curvature, and said tube having an end at which at least one other of said false-twist edges is disposed for diverting the yarn out of the yarn travel direction toward the opposite side.

* * * * *